US009205431B2

(12) United States Patent
Anderson, Jr.

(10) Patent No.: US 9,205,431 B2
(45) Date of Patent: Dec. 8, 2015

(54) VARIABLE SPEED MOTOR DRIVE FOR INDUSTRIAL MACHINE

(71) Applicant: Joy MM Delaware, Inc., Wilmington, DE (US)

(72) Inventor: Charles M. Anderson, Jr., Paris, KY (US)

(73) Assignee: Joy MM Delaware, Inc., Wilmington, DE (US)

( * ) Notice: Subject to any disclaimer, the term of this patent is extended or adjusted under 35 U.S.C. 154(b) by 133 days.

(21) Appl. No.: 13/830,798

(22) Filed: Mar. 14, 2013

(65) Prior Publication Data

US 2014/0263777 A1 Sep. 18, 2014

(51) Int. Cl.

| | |
|---|---|
| ***B02C 25/00*** | (2006.01) |
| ***B02C 4/08*** | (2006.01) |
| ***B02C 4/42*** | (2006.01) |

(52) U.S. Cl.

CPC . *B02C 25/00* (2013.01); *B02C 4/08* (2013.01); *B02C 4/42* (2013.01)

(58) Field of Classification Search

CPC ..... B02C 25/00
USPC ..... 241/3–365
See application file for complete search history.

(56) References Cited

U.S. PATENT DOCUMENTS

| | | | | |
|---|---|---|---|---|
| 3,598,327 | A | 8/1971 | Brandes | |
| 4,049,207 | A | 9/1977 | Storm et al. | |
| 4,073,445 | A | 2/1978 | Clonch | |
| 4,192,042 | A | 3/1980 | Jagst | |
| 4,401,279 | A | 8/1983 | DeVita et al. | |
| 4,486,199 | A | 12/1984 | Schenone et al. | |
| 4,592,516 | A | 6/1986 | Tschantz | |
| 4,691,870 | A * | 9/1987 | Fukunaga et al. | 241/36 |
| 5,088,651 | A | 2/1992 | Takahashi et al. | |
| 5,509,612 | A | 4/1996 | Gerteis | |
| 5,655,719 | A | 8/1997 | Getz | |
| 5,697,562 | A * | 12/1997 | Leblond | 241/101.74 |
| 5,716,014 | A * | 2/1998 | Tamura et al. | 241/36 |
| 5,803,376 | A * | 9/1998 | Koyanagi et al. | 241/36 |
| 5,911,373 | A | 6/1999 | Reid | |
| 6,164,572 | A | 12/2000 | Tudahl et al. | |
| 6,209,812 | B1 | 4/2001 | Jokinen | |
| 6,422,494 | B1 | 7/2002 | Reeves et al. | |
| 7,303,159 | B2 * | 12/2007 | Hishiyama et al. | 241/36 |
| 7,469,847 | B2 | 12/2008 | Fuller | |
| 8,118,246 | B2 * | 2/2012 | Yamaguchi et al. | 241/36 |

(Continued)

FOREIGN PATENT DOCUMENTS

| | | |
|---|---|---|
| GB | 2040506 | 8/1980 |
| JP | 2000093819 | 4/2000 |

*Primary Examiner* — Faye Francis
(74) *Attorney, Agent, or Firm* — Michael Best & Friedrich LLP

(57) ABSTRACT

An industrial machine that includes a breaker motor having a rotational speed, a breaker shaft, a sensor, and a controller. The breaker shaft is mechanically coupled to an output of the breaker motor, and the breaker shaft includes a plurality of tools operable to crush a material. The sensor is configured to generate a signal related to a parameter of the breaker motor. The controller is configured to receive the signal from the sensor, determine a value for the parameter of the breaker motor based on the received signal, compare the value for the parameter of the breaker motor to a threshold value, and generate a control signal for modifying the rotational speed of the breaker motor based on the comparison of the value for the parameter of the breaker motor to the threshold value.

18 Claims, 16 Drawing Sheets

(56) References Cited

U.S. PATENT DOCUMENTS

| | | | | |
|---|---|---|---|---|
| 8,360,349 | B1 | 1/2013 | Sotsky | |
| 2002/0002208 | A1 | 1/2002 | Martel et al. | |
| 2005/0173570 | A1* | 8/2005 | Tanaka et al. | 241/36 |
| 2009/0294559 | A1 | 12/2009 | Eriksson et al. | |
| 2009/0302141 | A1 | 12/2009 | Yamaguchi et al. | |
| 2010/0001110 | A1 | 1/2010 | Tschantz | |
| 2010/0237175 | A1* | 9/2010 | Becker et al. | 241/30 |
| 2012/0027902 | A1* | 2/2012 | Audette et al. | 426/518 |
| 2012/0234949 | A1* | 9/2012 | Morey | 241/28 |
| 2013/0200184 | A1* | 8/2013 | Schwelling | 241/25 |

* cited by examiner

VARIABLE SPEED MOTOR DRIVE FOR INDUSTRIAL MACHINE

BACKGROUND

The present invention relates to a motor drive for an industrial machine.

SUMMARY

Industrial machines (e.g., industrial mining machines) such as roll crushers or roll crushing devices are used to modify the size of a material (e.g., mined material) in mining and material handling industries. A roll crusher is a device that includes a shaft mounted with bearings to a frame and including one or more tools that physical engage a material (e.g., rocks, coal, etc.) in order to reduce the size of the material to a desired and/or predetermined particle size. Such a device can be implemented in a variety of different types of roll crushers, such as feeder-breakers, double roll crushers, single roll crushers, etc. Material is fed into the various types of roll crushers using, for example, a chain and flight type conveyor (as in a feeder-breaker), or using gravity (as in double roll crushers and single roll crushers) where a crushing action occurs between roll crushing shafts (e.g., double roll crushers) or between a roll crusher shaft and a frame (e.g., single roll crusher).

The roll crushers are driven by, for example, one or more electric motors driving a motor shaft and connected to a gear reduction to produce a fixed rotational speed for the roll crusher shaft. The force produced by the roll crusher shaft for material sizing is a function of the rotational speed of the roll crusher shaft and the rotational mass of the motor drive shaft and the roll crusher shaft. This force is concentrated at the roll crushers tools (e.g., breakers) such that the force is applied to the material in order to reduce the material to the desired particle size.

Embodiments of the invention described herein relate to an industrial machine and a motor drive or controller for the industrial machine. The controller is configured to change the rotational speed of a roll crusher shaft by controlling the speed of a motor (e.g., within a range of approximately +/−15% of motor synchronous speed). By manipulating the rotational speed of the roll crusher shaft, the roll crusher experiences lower tool wear (e.g., breaker wear), longer tool life, less downtime, lower power consumption, more consistent material sizing, and an ability to alter material product size dynamically within a range of values. These benefits can be realized without having to redesign the roll crusher or the crushing tools (e.g., breakers). The controller receives and uses signals received from sensors and various control methods to adjust or modify the speed to the electric motor to correspondingly control the speed of the roll crusher shaft.

In one embodiment, the invention provides an industrial machine that includes a breaker motor having a rotational speed, a breaker shaft, a conveyor, a sensor, and a controller. The breaker shaft is mechanically coupled to an output of the breaker motor, and the breaker shaft includes a plurality of tools operable to crush a material. The conveyor is configured to transport the material through the industrial machine. The sensor is configured to generate a signal related to a parameter of the breaker motor. The controller is configured to receive the signal from the sensor, determine a value for the parameter of the breaker motor based on the received signal, compare the value for the parameter of the breaker motor to a threshold value, and generate a control signal for modifying the rotational speed of the breaker motor based on the comparison of the value for the parameter of the breaker motor to the threshold value.

In another embodiment, the invention provides a method of controlling an industrial machine. The method includes receiving a signal from a sensor related to a parameter of a breaker motor. The breaker motor has a rotational speed, and the breaker motor is mechanically coupled to a breaker shaft that includes a plurality of tools operable to crush a material. The method also includes determining a value for the parameter of the breaker motor based on the received signal, comparing the value for the parameter of the breaker motor to a threshold value, and generating a control signal for modifying the rotational speed of the breaker motor based on the comparison of the value for the parameter of the breaker motor to the threshold value.

In another embodiment, the invention provides an industrial machine that includes a breaker motor having a rotational speed, a breaker shaft, a sensor, and a controller. The breaker shaft is mechanically coupled to an output of the breaker motor, and the breaker shaft includes a plurality of tools operable to crush a material. The sensor is configured to generate a signal related to a parameter of the breaker motor. The controller is configured to receive the signal from the sensor, determine a value for the parameter of the breaker motor based on the received signal, compare the value for the parameter of the breaker motor to a threshold value, and generate a control signal for modifying the rotational speed of the breaker motor based on the comparison of the value for the parameter of the breaker motor to the threshold value.

Other aspects of the invention will become apparent by consideration of the detailed description and accompanying drawings.

DETAILED DESCRIPTION

Figure 1:
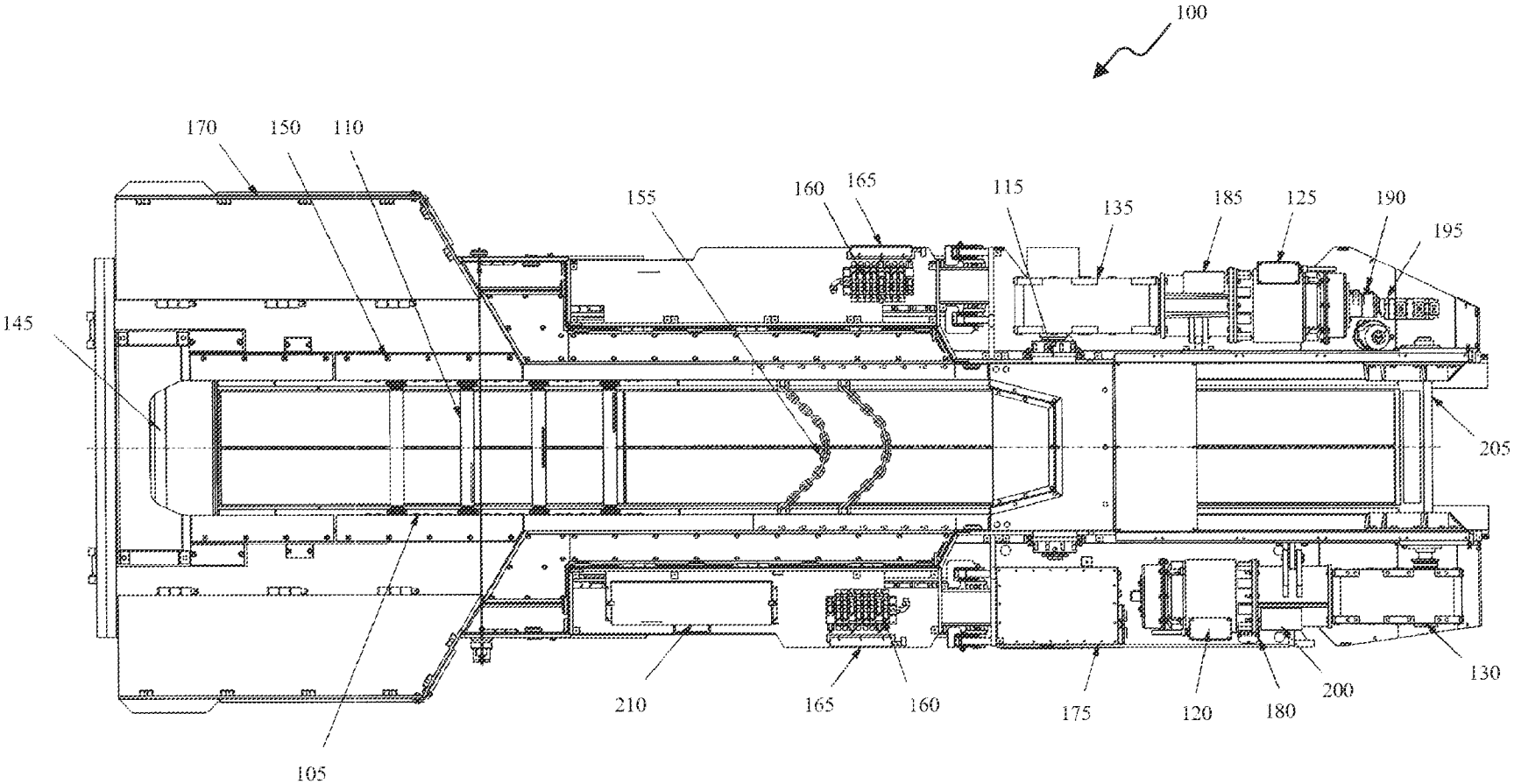
FIG. 1 is a top-view of an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

The invention described herein relates to an industrial machine, such as a feeder-breaker or a sizer (e.g., a single roll crusher, a double roll crusher, etc.). The industrial machine includes, for example, at least one breaker motor and at least one conveyor motor (i.e., in feeder-breaker embodiments). A controller of the industrial machine is configured to monitor a variety of sensor signals related to the operational characteristics or parameters of the motors in order to determine an operational state of the industrial machine. The operational state of the industrial machine can include, for example, a load level on a breaker shaft, a load level on a conveyor, a speed of the motors, a power of the motors, a torque of the motors, a load of the motors, etc. The controller, or one or more dedicated drives connected to the controller, is operable to detect the condition associated with the industrial machine and modify the operational speed of the breaker motor or conveyor motor in order to improve the operation of the industrial machine. For example, the operational speed of the motors can be modified to improve throughput, reduce wear, improve consistency of output material, etc. In each instance, parameters of the breaker motor and/or conveyor motor are monitored and controlled (e.g., adjusted or modified) in order to achieve improved performance of the industrial machine without having to redesign or reconfigure mechanical aspects of the industrial machine.

The invention can be implemented in a variety of industrial machines, such as a feeder-breaker. A feeder-breaker is a low-profile crushing device that includes, for example, a horizontal roll crushing system (general referred to as a "breaker shaft"), a conveyor system, a hopper, and optional wheels or tracks that allow for the movement of the industrial machine. The specific implementations of a feeder-breaker can take any of a variety of forms based upon, among other things, material hauling devices, material feed size, material throughput, etc.

Figure 2:
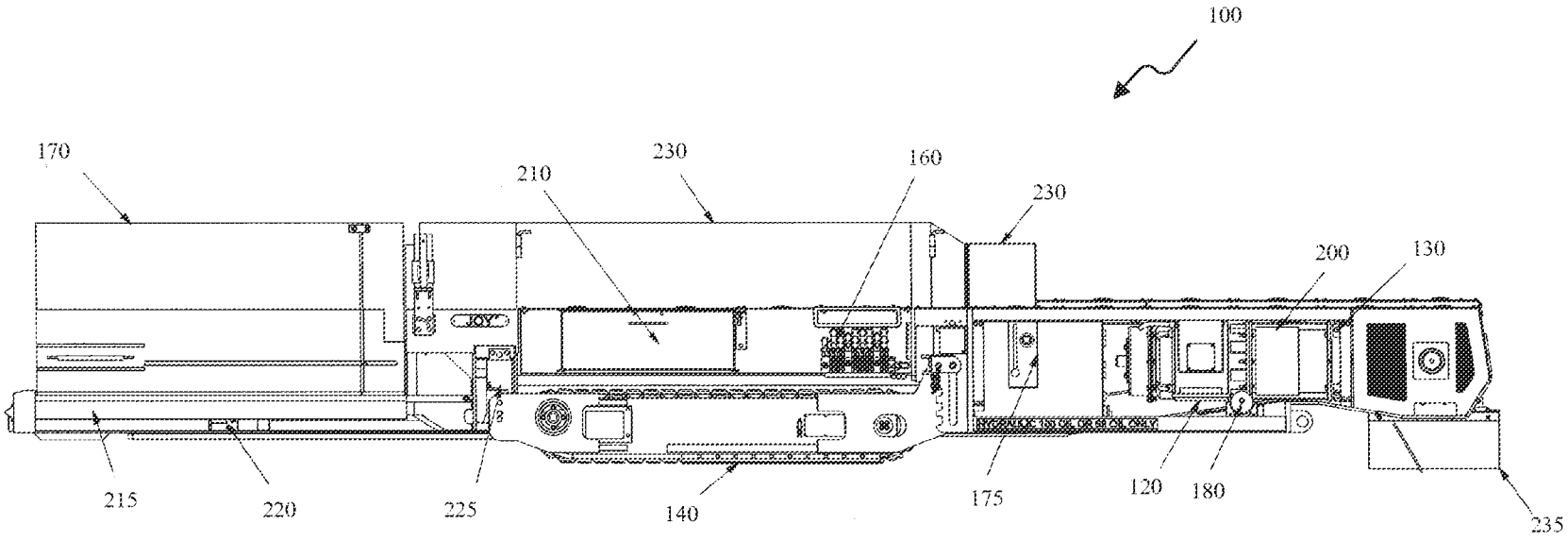
FIG. 2 is a side-view of the industrial machine of FIG. 1.

FIGS. 1 and 2 illustrate a feeder-breaker 100 according to one implementation of the invention. The feeder-breaker 100 includes a variable speed drive for controlling the rotational speed of a breaker shaft. The industrial machine 100 also includes, among other things, a conveyor and conveyor chain 105, conveyor flights 110, a breaker assembly 115, a first motor or conveyor motor 120, a second motor or breaker motor 125, a first speed reducer (e.g., gear reduction) 130, a second speed reducer (e.g., gear reduction) 135, and a crawler 140. The industrial machine 100 also includes, for example, a tailshaft 145, chain covers 150, choke chains 155, hydraulic control valves 160, panic bars 165, folding gates 170, a hydraulic tank 175, a hydraulic filter 180, a torque limiting clutch 185, a hydraulic pump disconnect 190, a hydraulic pump 195, a coupling 200, a headshaft 205, a starter 210, a take-up bearing 215, a take-up 220, a hopper jack cylinder 225, sideboards 230, and a discharge chute 235. A drive is generally referred to with respect to a motor, but the drive can also include, for example, a clutch, a gear reduction (e.g., speed reducer), etc.

Figure 3:
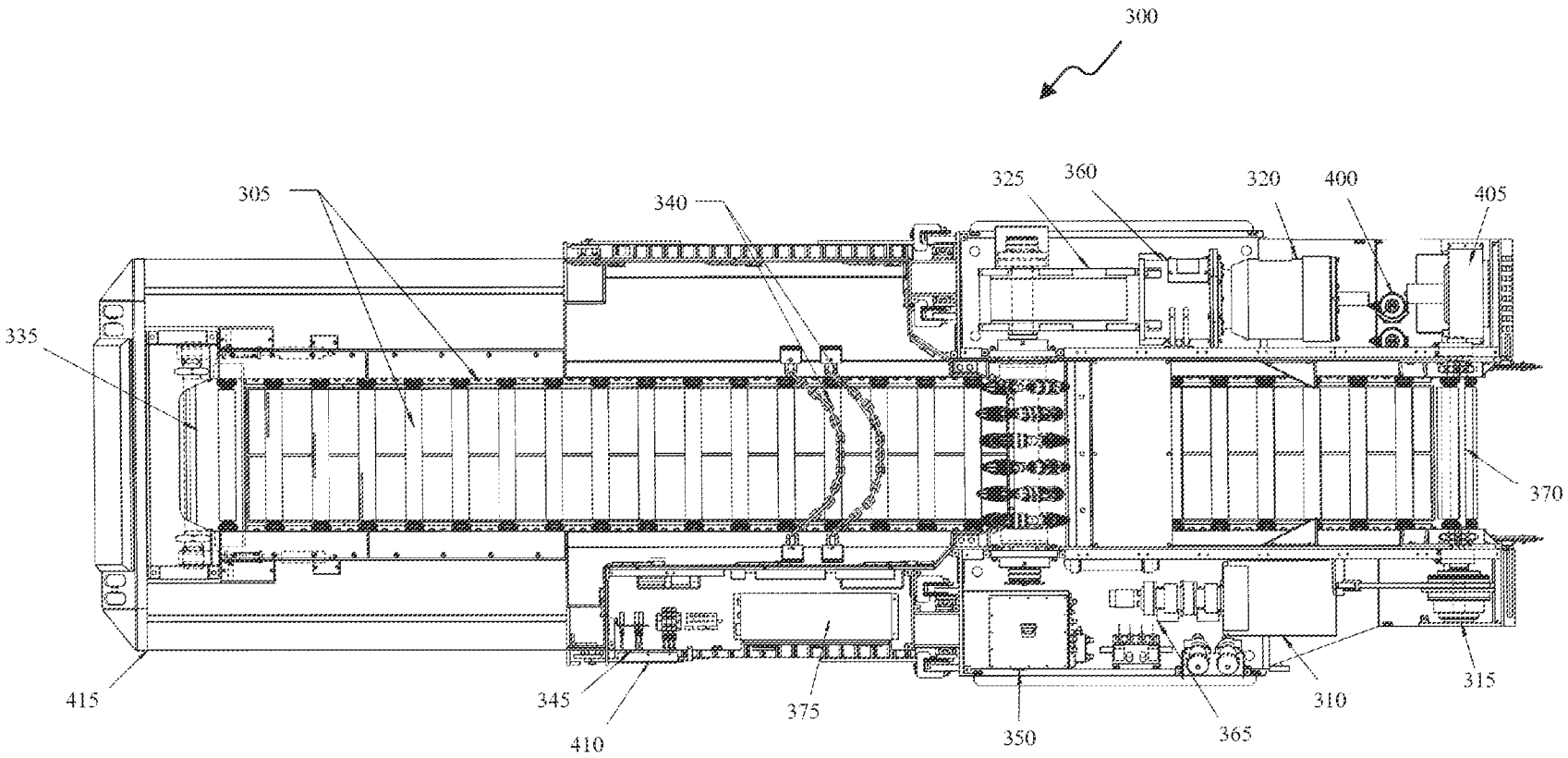
FIG. 3 is a top-view of an industrial machine according to another embodiment of the invention.
Figure 4:
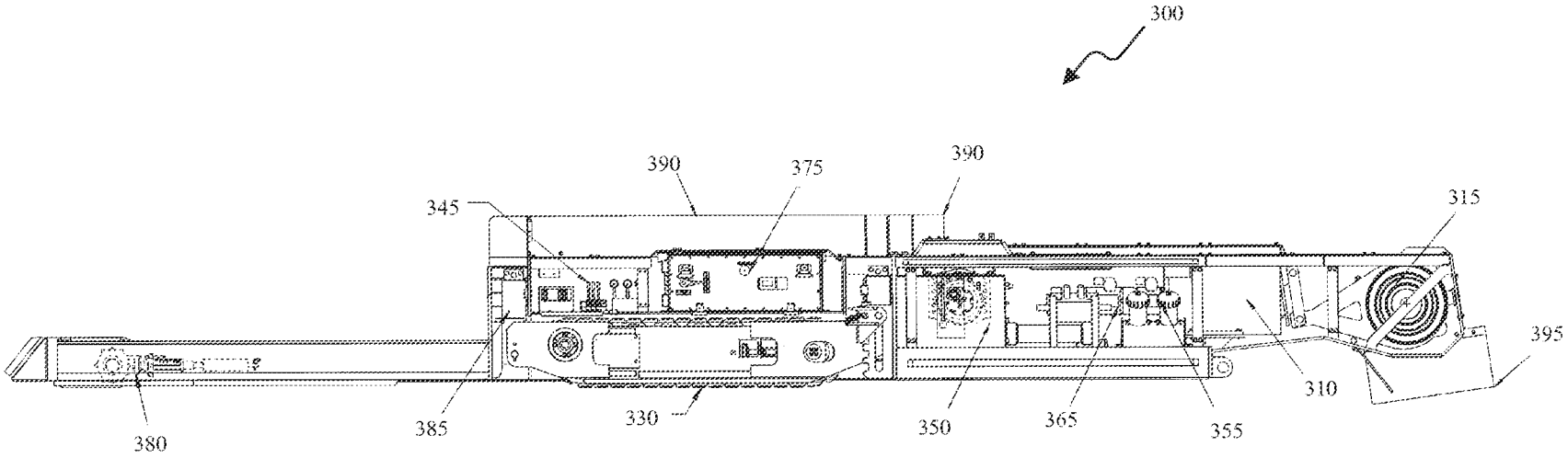
FIG. 4 is a side-view of the industrial machine of FIG. 3.

Another implementation of a feeder-breaker 300 is illustrated in FIGS. 3 and 4. The feeder-breaker 300 also includes a variable speed drive for controlling the rotational speed of a breaker shaft, as well as, among other things, a conveyor with chain and flights 305, a first electric motor 310, a hydraulic motor 315, a second electric motor or breaker motor 320, a speed reducer (e.g., gear reduction) 325, and a crawler 330. The industrial machine 300 also includes, for example, a tailshaft 335, choke chains 340, hydraulic control valves 345, a hydraulic tank 350, hydraulic filters 355, a torque limiting clutch 360, a hydraulic pump 365, a headshaft 370, a starter 375, a take-up 380, a hopper jack cylinder 385, sideboards 390, a discharge chute 395, fire suppression tanks 400, a heat exchanger 405, a tape switch 410, and a dump intake end 415 (e.g., a three-way dump intake end).

Figure 5:
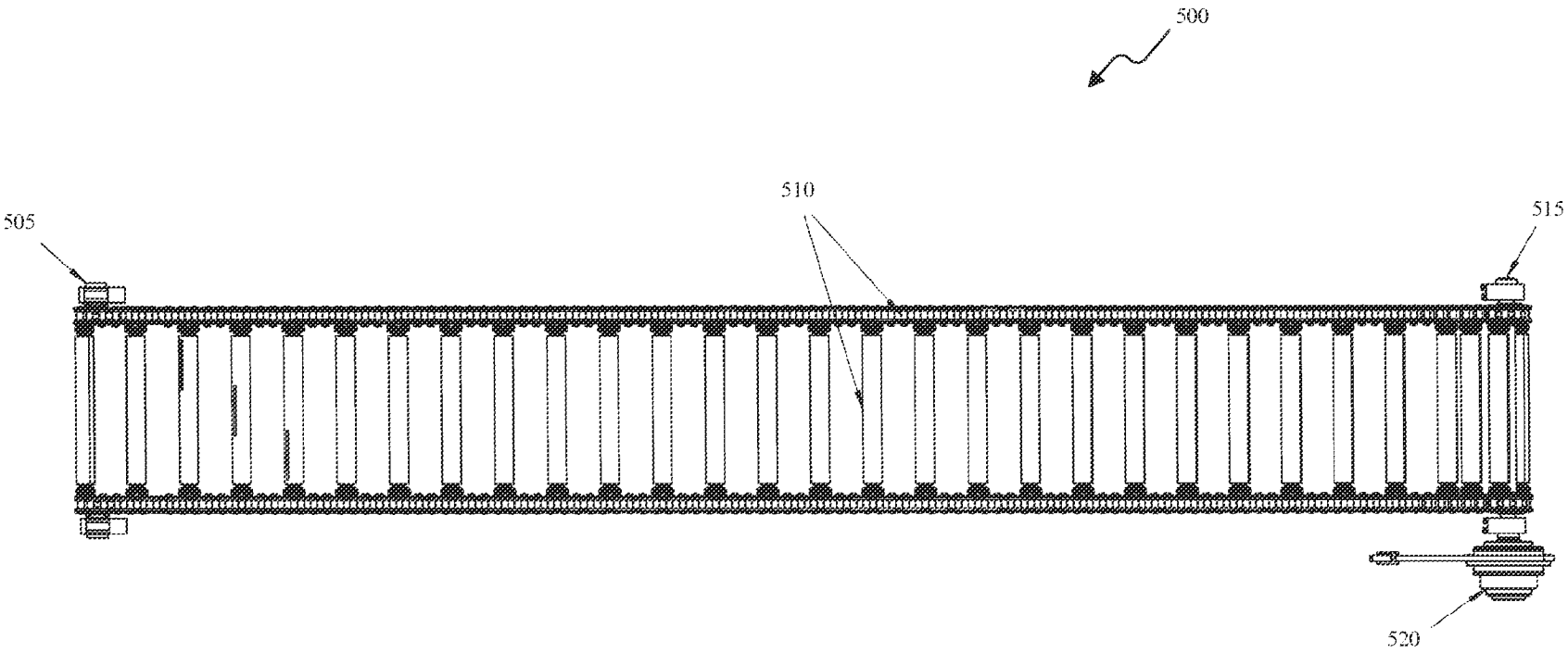
FIG. 5 is a top-view of a conveyor assembly according to an embodiment of the invention.
Figure 6:
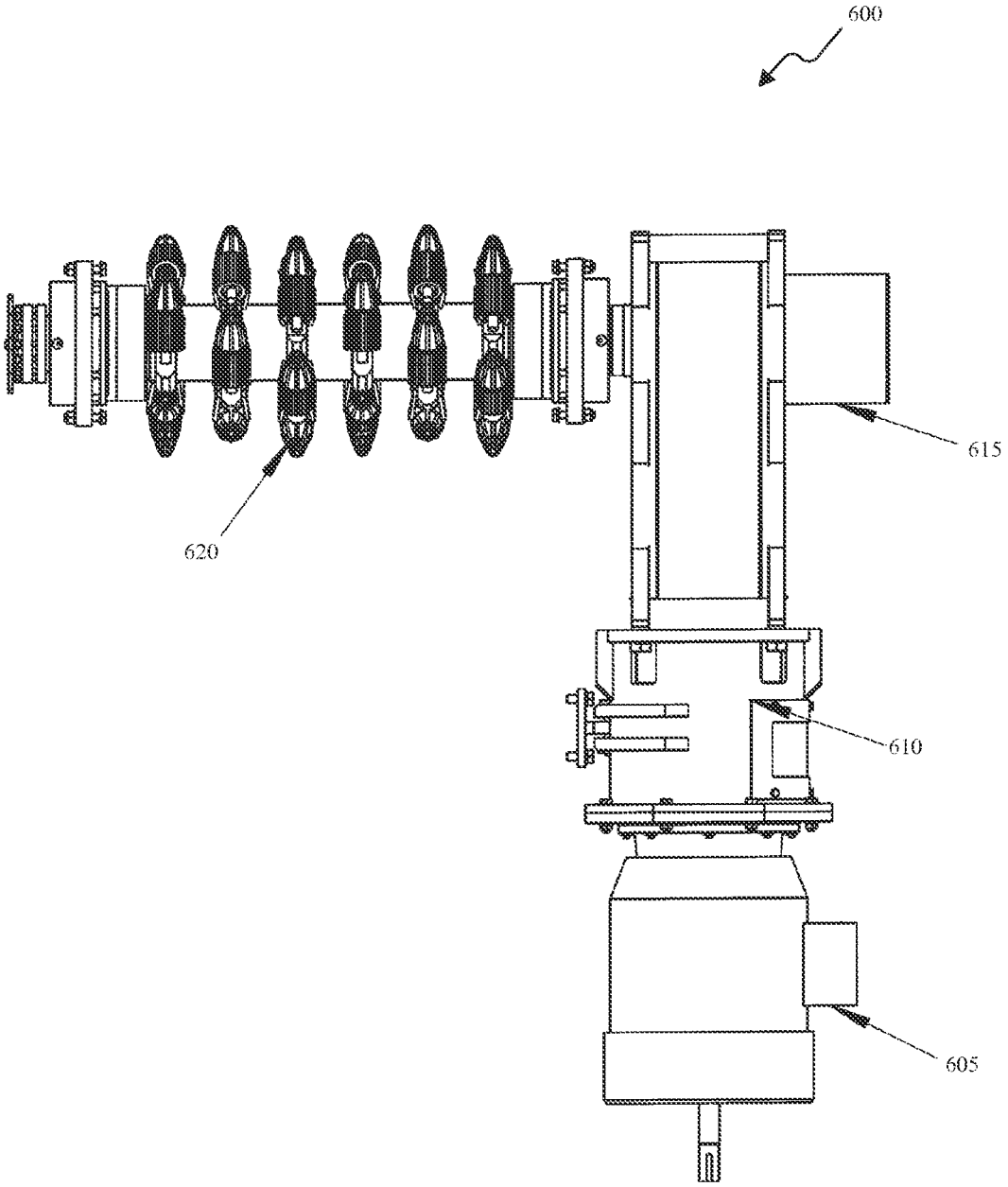
FIG. 6 is a top-view of a breaker shaft assembly according to an embodiment of the invention.
Figure 7:
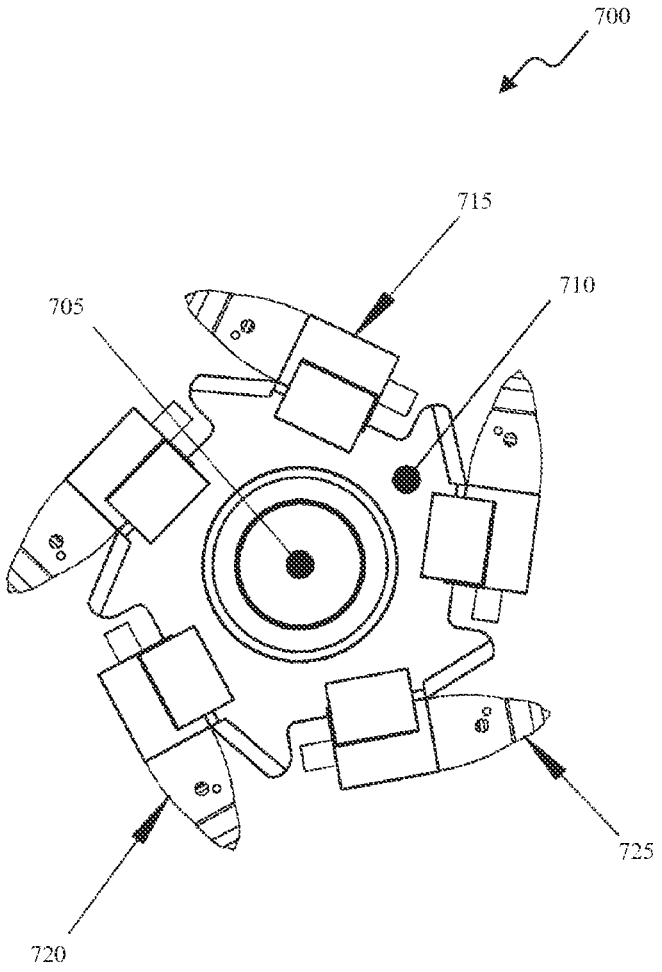
FIG. 7 illustrates a crushing device according to an embodiment of the invention.
Figure 8:
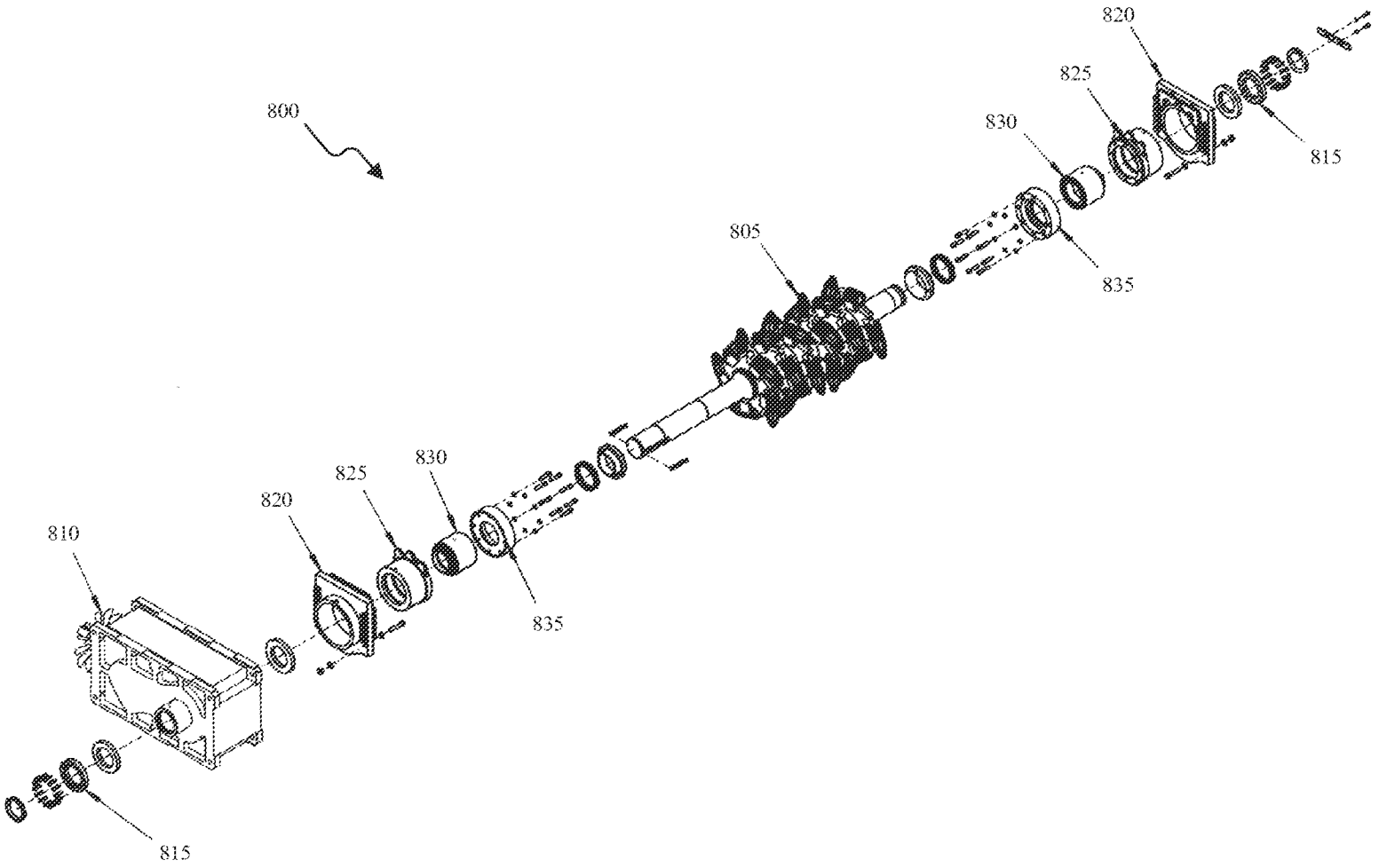
FIG. 8 is an exploded-perspective-view of a breaker shaft according to an embodiment of the invention.

Before describing the operation of the feeder-breakers 100 and 300 in detail, various subsystems are illustrated in FIGS. 5-8 to further demonstrate how the primary systems of a feeder-breaker are assembled. For example, FIG. 5 illustrates a conveyor assembly 500 for the industrial machine 100 or the industrial machine 300 that includes a tailshaft 505, a conveyor chain and flights 510, a headshaft 515, and a hydraulic conveyor drive 520. In some embodiments, the conveyor assembly 500 includes an electric motor and speed reducer for driving the conveyor. FIG. 6 illustrates a breaker assembly 600 that includes an electric motor 605, a torque limiting clutch 610, a speed reducer 615, and a breaker shaft 620. FIG. 7 illustrates a crushing device or tool 700 that includes a shaft 705, a breaker ring 710, a holder 715, an intermediate holder 720, and a breaker pick 725. FIG. 8 illustrates a breaker shaft assembly 800 that includes a breaker shaft 805, a speed reducer 810, compression rings 815, breaker mounting plates 820, bearing housings 825, bearings 830, and bearing retainers 835.

For descriptive purposes, the invention will be described with respect to the feeder-breaker 100, although the below description of the operation of a feeder-breaker can also be applied to the feeder-breaker 300. With reference to FIG. 6, the feeder-breaker 100 includes the horizontally mounted roll crusher shaft 620 driven by the shaft mounted speed reducer 615 in combination with the electric motor 605. In some embodiments, the feeder-breaker 100 includes a chain and sprocket drive including a flywheel and a speed reducer that is driven by an electric motor mounted to a frame of the feeder-breaker 100. A material breaking force for the feeder-breaker 100 is produced as a result of the rotational mass of the breaker shaft 620 in combination with the speed of the breaker shaft 620. The material breaking force is limited by an overload device or controller, as well as the conveyor chain and flight bars described above (e.g., by controlling the speed at which material can be passed through the feeder-breaker). This breaking force of the feeder-breaker 100 is related (e.g., directly related) to the material's resistance to the crushing action of the breaker picks that are mounted to the roll crusher shaft. The harder the material; the higher the force developed by the breaker shaft and breaker motor when crushing the material.

The conveyor system includes the chains 105 and flight bars 150 driven in an endless loop around the frame of the feeder-breaker 100. The conveyor system also includes the head shaft or driving shaft 205 where the conveyor drive is connected and a tail shaft or idler shaft 145 where the chain and flight bar assembly is returned back onto the deck the feeder-breaker 100. The conveyor drive can be directly or indirectly coupled to one or more hydraulic motors or one or more electric motors (e.g., motor 120) and one or more speed reducers (e.g., speed reducer 130) that are directly coupled to the head shaft 205 or indirectly coupled to the head shaft 205 via chains and sprockets.

The chain and flight bar assembly is configured to drag material up to and through the breaker assembly 115. The chain and flight bar assembly provides a resistance to the material to allow the breaker shaft tools (e.g., breaker picks) to penetrate and separate the material as the material passes through the breaker assembly 115. Material is dumped into the feeder-breaker material haulage vehicles through a hopper at the tailshaft 145. The hopper provides a surge capacity to the feeder-breaker 100 to allow material hauling vehicles to dump the material into the feeder-breaker at a maximum possible rate. The feeder-breaker 100 can also either be fixed (e.g., permanently mounted), semi-mobile (e.g., via skids or wheels), or fully-mobile (e.g., using self-powered crawler tracks).

As an alternative to a feeder-breaker, the invention can also be implemented in, for example, a sizer. The specific implementations of a sizer can also take any of a variety of forms (e.g., single roll crusher, double roll crusher, etc.) based upon, among other things, material feed size, material throughput, type of material, etc. A double roll crusher is an industrial machine in which a material to be crushed is fed by gravity, and in which each of the breaker shafts turn toward each other to create a collapsible pocket in which material is broken by the breaker shaft's tools (e.g., breaker picks or bit blocks).

Figure 9:
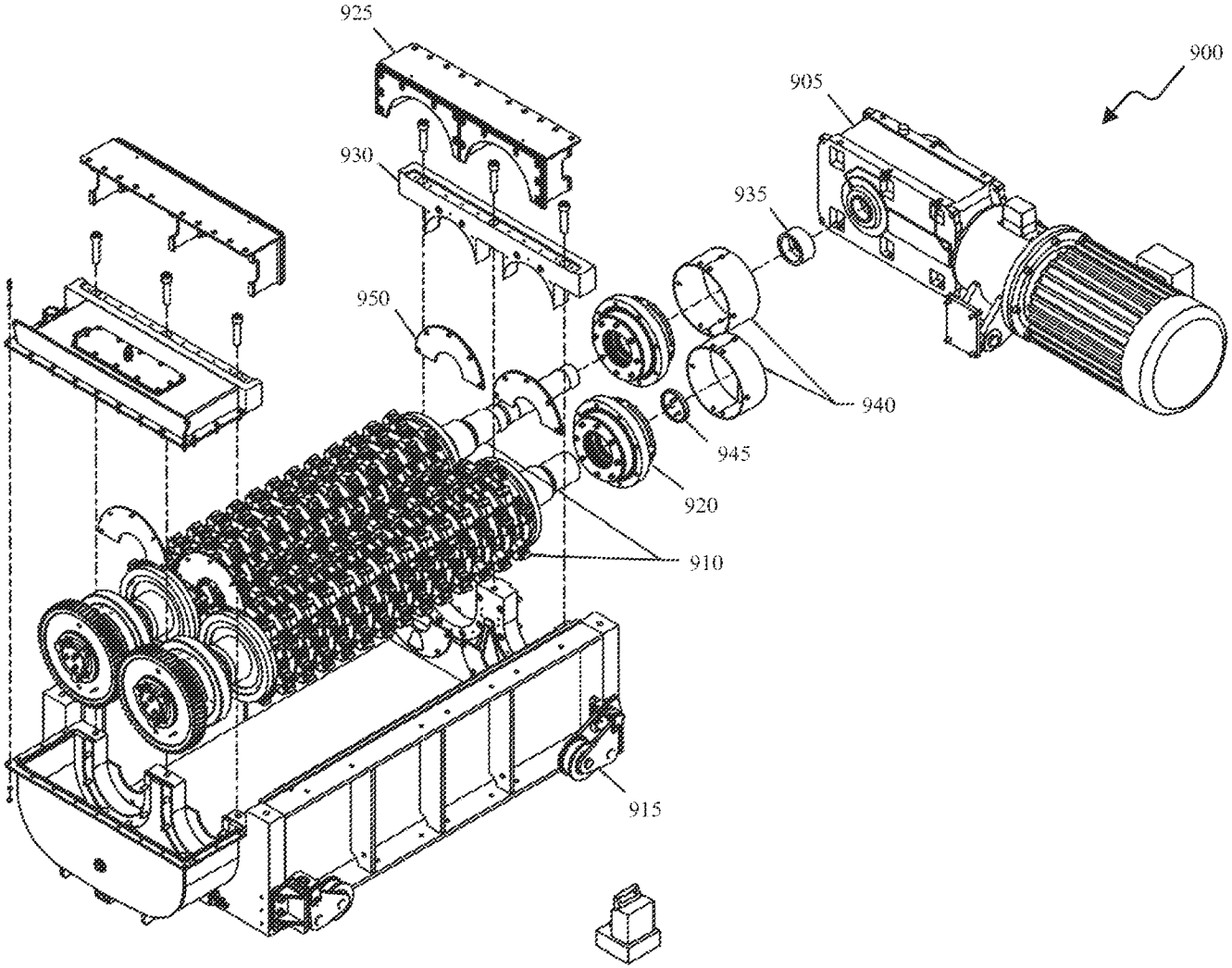
FIGS. 9-11 illustrate a material sizer according to an embodiment of the invention.
Figure 10:
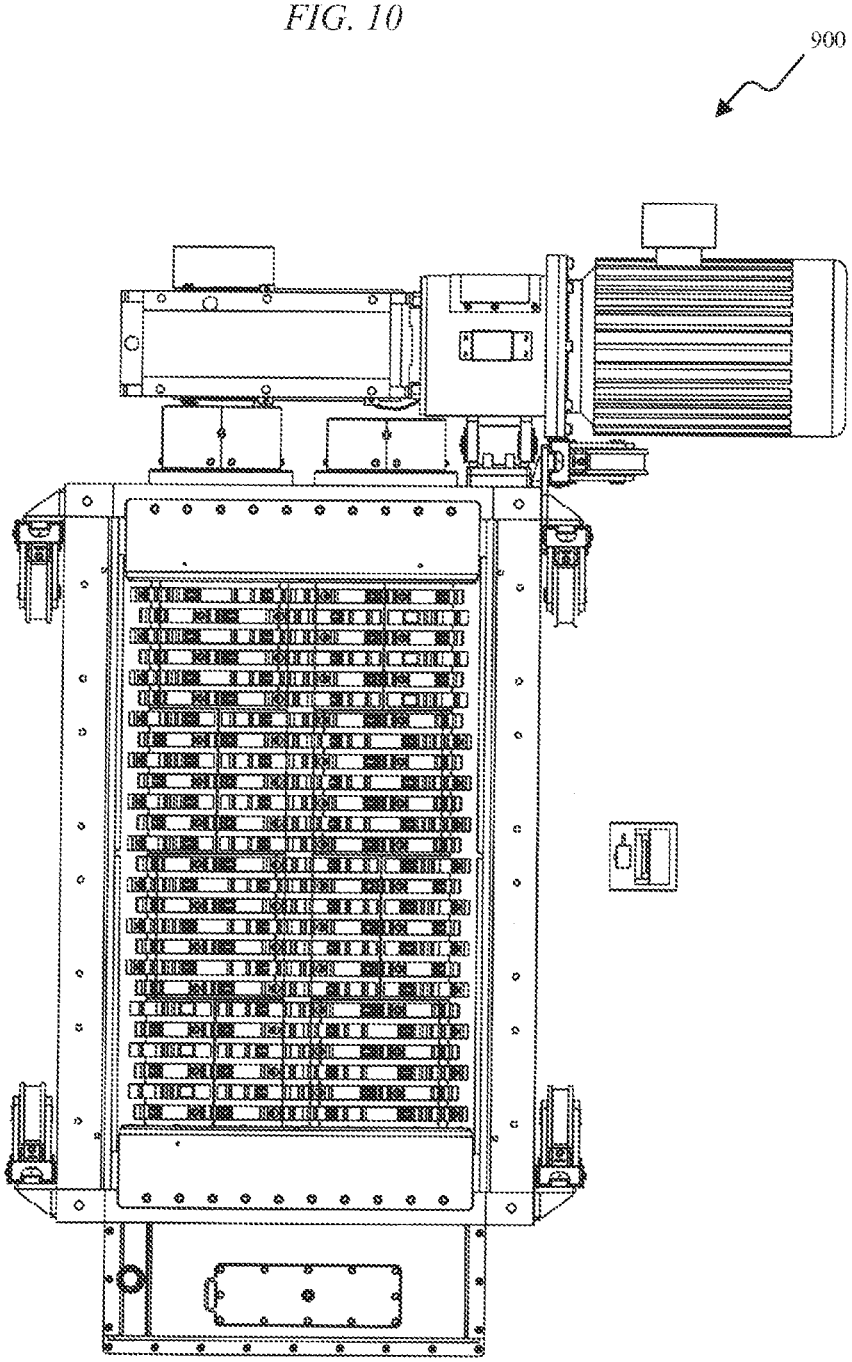
Figure 11:
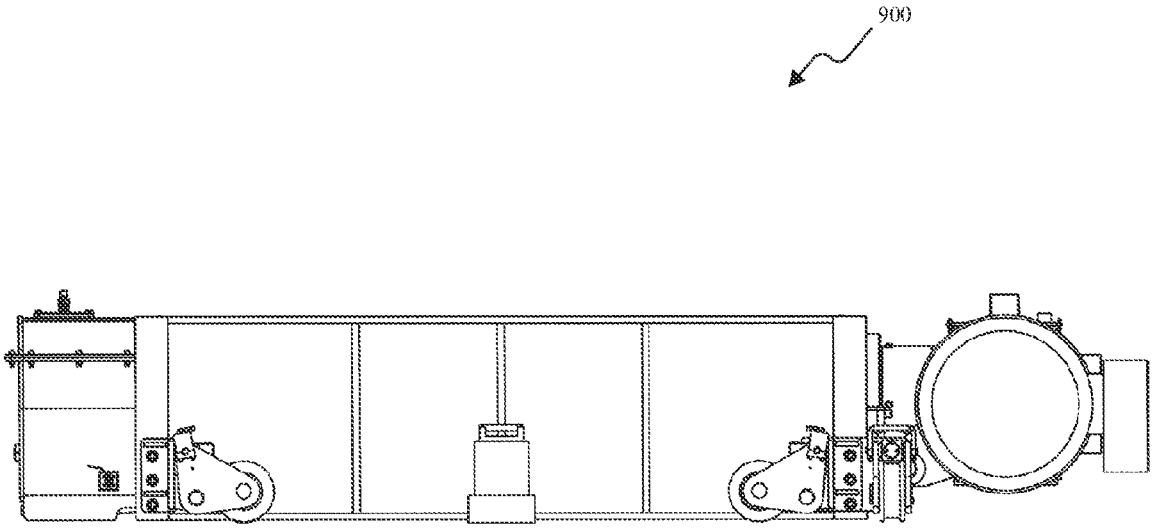

FIGS. 9-11 illustrate a double roll crusher 900 that includes a drive assembly 905, a roll shaft assembly 910, a wheel assembly 915, a bearing assembly 920, an end liner 925, a frame section 930, a spacer 935, outside bearing cover 940, and end cap 945, and an inside bearing cover 950.

Figure 12:
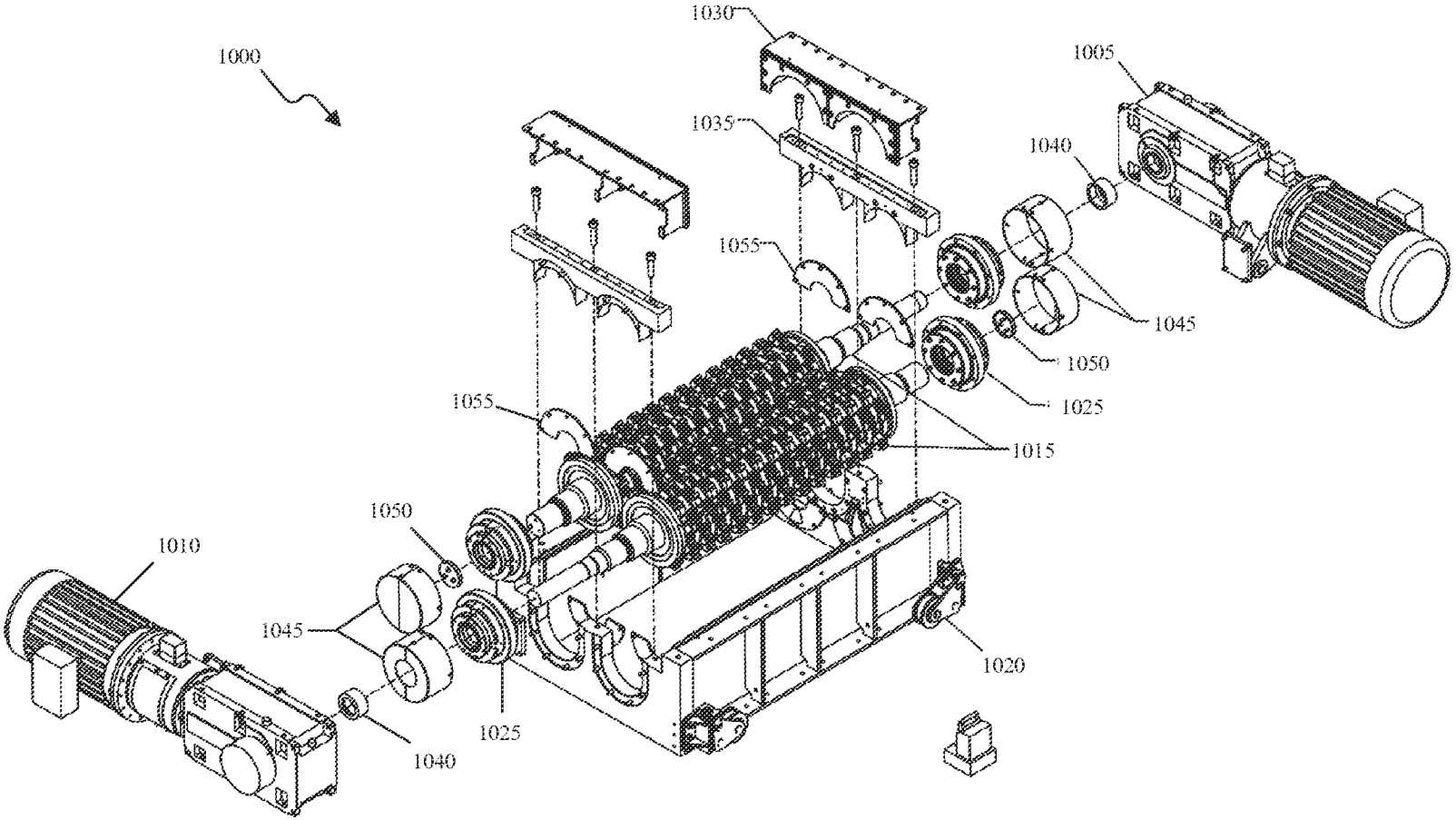
FIGS. 12-14 illustrate a material sizer according to another embodiment of the invention.
Figure 13:
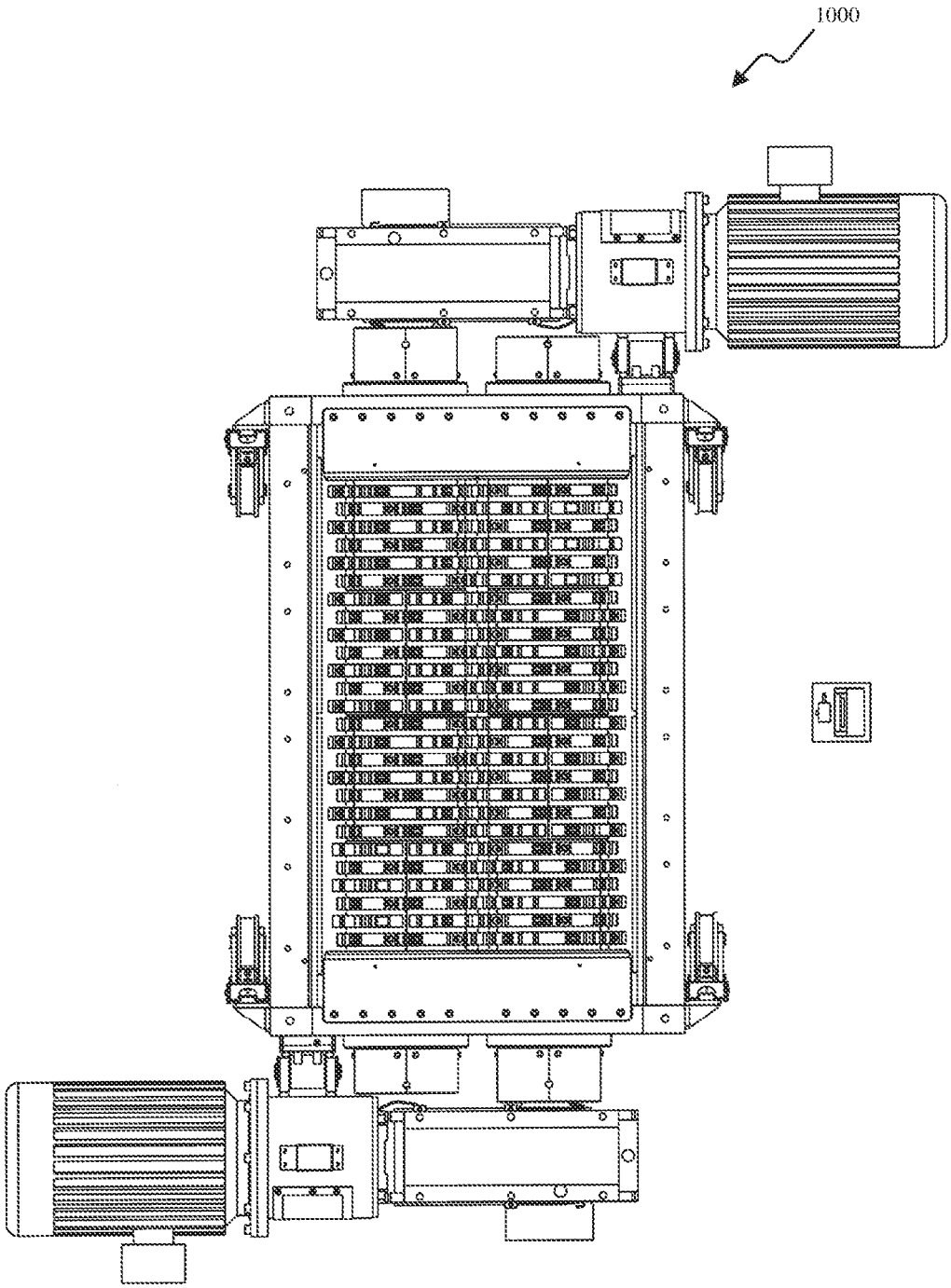
Figure 14:
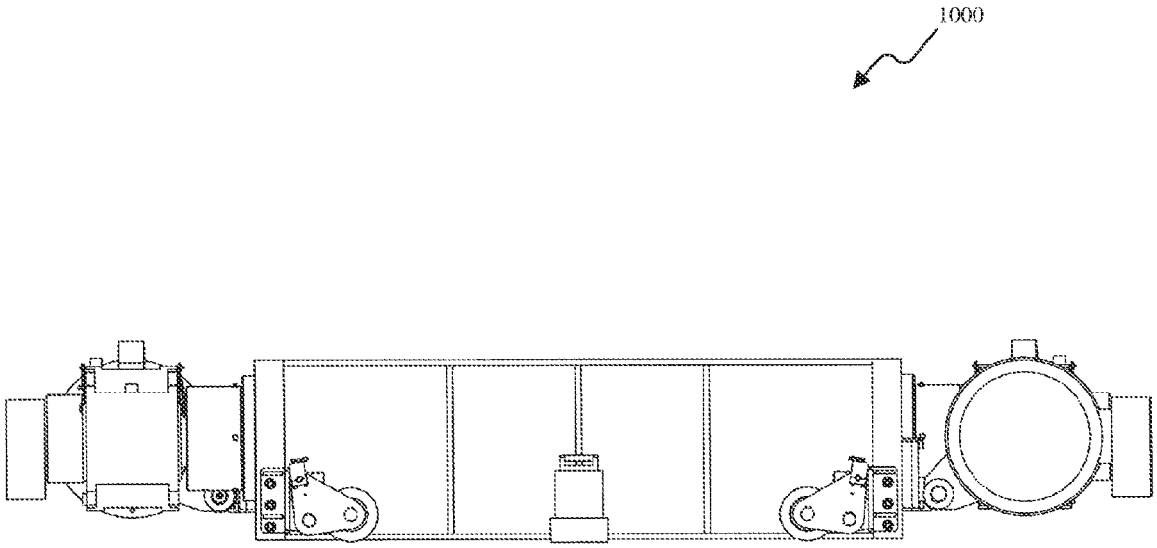

Another double roll crusher 1000 is illustrated in FIGS. 12-14. The double roll crusher 1000 includes a double roll crusher 1000 that includes a first drive assembly 1005, a second drive assembly 1010, a breaker roll shaft assembly 1015, a wheel assembly 1020, bearing assemblies 1025, an end liner 1030, a frame section 1035, spacers 1040, outside bearing covers 1045, end caps 1050, and inside bearing covers 1055.

As indicated above, a double roll crusher includes two breaker shafts for crushing material. In some embodiments, the breaker shafts are synchronized using a timing gear set and are driven by an electric motor and a speed reducer connected to one of the two breaker shafts. In other embodiments, each of the breaker shafts can be independently driven using respective electric motors and speed reducers. The breaker shafts are mounted in a frame such that the distance between the breaker shafts, in combination with the speed of the speed of the breaker shafts determines both the throughput of the double roll crusher and the and size of the material output by the double roll crusher. In some embodiments, the speed of the breaker shafts at a centerline of the breaker shafts are matched to the speed of a conveyor belt that is feeding material to the double roll crusher. In such embodiments, the matched speed of the breaker shafts to the stream of material ensures a minimum amount of material waste product (e.g., improperly sized output material).

Figure 15:
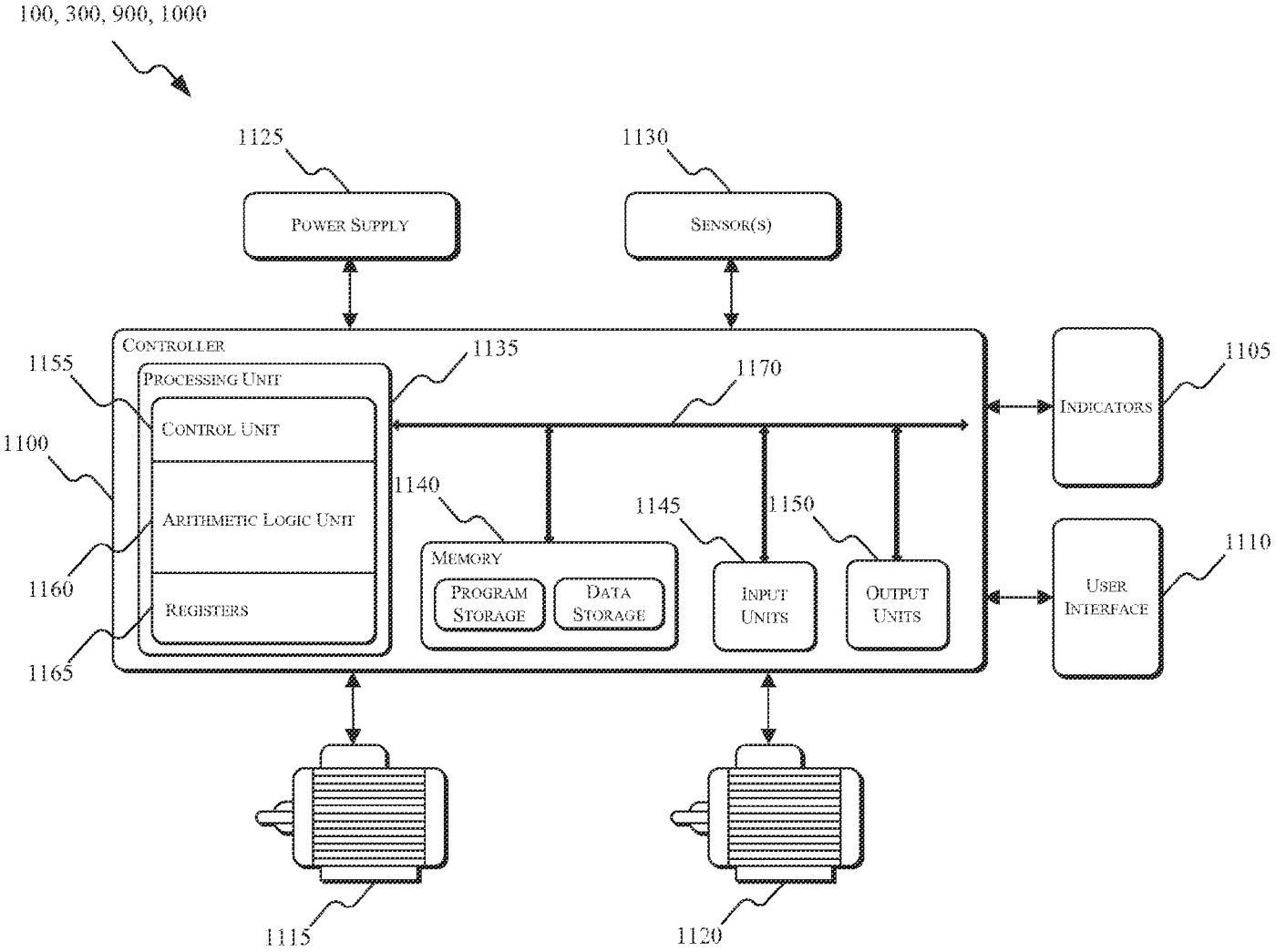
FIG. 15 is a controller for an industrial machine according to an embodiment of the invention.

FIG. 15 illustrates a controller 1100 associated with the industrial machines 100, 300, 900, and 1000. The controller 1200 is electrically and/or communicatively connected to a variety of modules or components of the industrial machines. For example, the illustrated controller 1100 is connected to one or more indicators 1105, a user interface module 1110, one or more conveyor motor and conveyor motor drives 1115, one or more breaker motors and breaker motor drives 1120, a power supply module 1125, and one or more sensors 1130. The controller 1100 includes combinations of hardware and software that are operable to, among other things, control the operation of the industrial machines, control the speed of the motors 1120 and 1125, activate the one or more indicators 1105 (e.g., a liquid crystal display ["LCD"]), monitor the operation of the industrial machines, etc. The one or more sensors 1130 include, among other things, one or more current sensors, one or more current transformers, one or more speed sensors (e.g., multiple Hall Effect sensors), rotational speed sensors, one or more voltage sensors, one or more torque sensors, one or more pressure transducers, one or more belt weigh scales, one or more cameras for detecting or sensing product particle size, one or more resistance temperature detectors, etc. The motors 1115 and 1120 can be, for example, direct current ("DC") motors, alternating current ("AC") induction motors, AC wound rotor motors, brushless DC ("BLDC") motors, permanent magnet motors, switched reluctance motors, synchronous switched reluctance motors, hydraulic motors, etc., or combinations thereof.

In some embodiments, the controller 1100 includes a plurality of electrical and electronic components that provide power, operational control, and protection to the components and modules within the controller 1100 and/or industrial machines 100, 300, 900, and 1000. For example, the controller 1100 includes, among other things, a processing unit 1135 (e.g., a microprocessor, a microcontroller, or another suitable programmable device), a memory 1140, input units 1145, and output units 1150. The processing unit 1135 includes, among other things, a control unit 1155, an arithmetic logic unit ("ALU") 1160, and a plurality of registers 1165 (shown as a group of registers in FIG. 15), and is implemented using a known computer architecture, such as a modified Harvard architecture, a von Neumann architecture, etc. The processing unit 1135, the memory 1140, the input units 1145, and the output units 1150, as well as the various modules connected to the controller 1100 are connected by one or more control and/or data buses (e.g., common bus 1170). The control and/or data buses are shown generally in FIG. 15 for illustrative purposes. The use of one or more control and/or data buses for the interconnection between and communication among the various modules and components would be known to a person skilled in the art in view of the invention described herein. In some embodiments, the controller 1100 is implemented partially or entirely on a semiconductor (e.g., a field-programmable gate array ["FPGA"] semiconductor) chip, such as a chip developed through a register transfer level ("RTL") design process. In some embodiments, the industrial machines include one controller, such as controller 1100, for each breaker or conveyor motor.

The memory 1140 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 1135 is connected to the memory 1140 and executes software instructions that are capable of being stored in a RAM of the memory 1140 (e.g., during execution), a ROM of the memory 1140 (e.g., on a generally permanent basis), or another non-transitory computer readable medium such as another memory or a disc. Software included in the implementation of the industrial machines can be stored in the memory 1140 of the controller 1100. The software includes, for example, firmware, one or more applications, program data, filters, rules, one or more program modules, and other executable instructions. The controller 1100 is configured to retrieve from memory and execute, among other things, instructions related to the control processes and methods described herein. In other constructions, the controller 1100 includes additional, fewer, or different components.

The power supply module 1125 supplies a nominal AC or DC voltage to the controller 1100 or other components or modules of the industrial machines 100, 300, 900, and 1000. The power supply module 1125 is powered by, for example, a power source having nominal line voltages between 100V and 240V AC and frequencies of approximately 50-60 Hz. The power supply module 1135 is also configured to supply lower voltages to operate circuits and components within the controller 1100 industrial machines 100, 300, 900, and 1000. In other constructions, the controller 1100 or other components and modules within the industrial machines are powered by one or more batteries or battery packs, or another grid-independent power source (e.g., a generator, a solar panel, etc.).

The user interface module 1110 is used to control or monitor the industrial machines 100, 300, 900, and 1000. For example, the user interface module 1110 is operably coupled to the controller 1100 to control the speed of a conveyor, the rotational speed of a breaker shaft, the rotational speed of a motor, etc. The user interface module 1110 includes a combination of digital and analog input or output devices required to achieve a desired level of control and monitoring for the industrial machines. For example, the user interface module 1110 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 1110 can also be configured to display conditions or data associated with the industrial machines in real-time or substantially real-time. For example, the user interface module 1110 is configured to display measured electrical characteristics of the industrial machines, the status of the industrial machines, speed of the motors, the speed of a conveyor, a type of material, etc. In some implementations, the user interface module 1110 is controlled in conjunction with the one or more indicators 1105 (e.g., LEDs, speakers, etc.) to provide visual or auditory indications of the status or conditions of the industrial machines 100, 300, 900, and 1000.

The controller 1100 uses signals received from the sensors 1130 related to the operation of a feeder-breaker to, for example, implement a feedback system between the motor for the breaker shaft and the motor for the conveyor. For example, the controller 1100 can use a voltage, a current, a speed, a torque, a power, hydraulic pressure, etc., associated with the motor for the breaker shaft to determine an amount of loading that the breaker shaft is experiencing. Based on the sensed loading on the breaker motor, the controller 1100 adjusts the speed of the breaker motor or the conveyor motor to reduce loading on the breaker shaft. The controller is configured to change the rotational speed of a roll crusher shaft by controlling the speed of the breaker motor within a range of values, and/or change the speed of the conveyor by controlling the speed of the conveyor motor. With respect to each of the breaker motor and the conveyor motor, the controller 1100 is configured to modify the rotational speed of the motor either up by a speed value or down by a speed value. In some embodiments, the speed of the motors can be increased by, for example, approximately +10%, +20%, +30%, or by a value of between approximately +1% and +30%. (e.g., with respect to a synchronous speed of the motor). Similarly, the speed of the motors can be decreased by, for example, approximately −10%, −20%, −25%, or by a value of between approximately −1% and −25%. (e.g., with respect to a synchronous speed of the motor).

As an illustrative example, if the breaker motor's load is high (e.g., above a threshold value or over-loaded value), the speed of the conveyor motor can be reduced in order to reduce the loading on the breaker motor and breaker shaft. Additionally or alternatively, if the conveyor motor is operating at full speed and the breaker motor is not heavily or overly loaded (e.g., the loading is not above a threshold value), the breaker motor has available capacity and the speed of the breaker motor can be increased. In such an instance, increasing the speed of the breaker motor increases the speed of the breaker shaft in order to maximize the material throughput of the feeder-breaker without overloading the breaker motor.

In some embodiments, the speed of the breaker shaft can also be modified based on the density of the material being processed by the industrial machine. A higher density or harder material creates more loading on the breaker shaft than a lower density or relatively softer material. As such, if a first type of material is expected to be processed by the industrial machine (e.g., coal) based upon, for example, an input value from an operator, but the industrial machine is instead loaded with a harder material (e.g., rock), the controller 1100 can detect the increased loading (i.e., beyond the loading expected or greater than a threshold value), determine that the material being processed is a denser material, and slow the breaker motor to reduce the speed of, and wear on, the breaker shaft.

When implementing the invention in a sizer (e.g., a double roll crusher, a single roll crusher, etc.), the speed of the breaker shafts can be controlled to limit the amount of waste (i.e., improperly sized material) that passes through the roll crusher. Additionally, as the breaker picks on the breaker shafts are worn, additional speed can be applied to the breaker shafts to maintain consistent and desired material sizing as the clearance between the two breakers increases. In embodiments of the invention that include two independent breaker motors, adjustable product sizing can be achieved by modifying the speed of one or both the breaker motors. Additionally, the rotational direction of the breaker shaft can be reversed for clearing jams or unbreakable objects in the double roll crusher, and differential speeds for the individual breaker shafts can be used to provide a scrubbing action that liberates clays and or waste materials, which increases the amount of desirable product that is output from the roll crusher. That is, the breaker shafts can be used to clean themselves of sticky materials using a speed difference between the two shafts.

Figure 16:
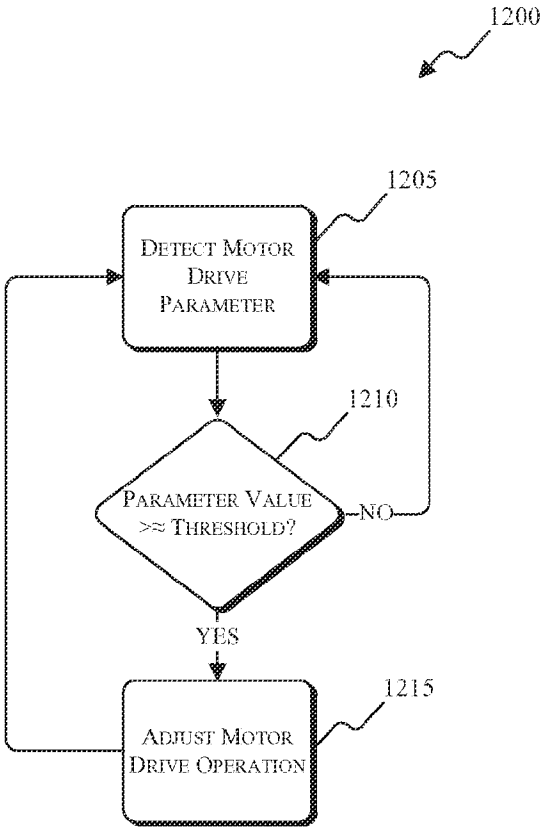
FIG. 16 is a process for controlling an industrial machine according to an embodiment of the invention.

FIG. 16 is a process 1200 for adjusting the operation of a breaker drive in order to control the amount and/or quality of a material processed by an industrial machine, as well as reduce the strain and wear experienced by a breaker shaft and the industrial machine. At step 1205, a motor drive parameter for the industrial machine is determined. The motor drive parameter corresponds to, for example, a current, a voltage, torque, a temperature, a power, a load, etc. for the motor driving a breaker shaft. As described above, the breaker shaft is connected to the motor through a speed reducer (e.g., gear reduction) and a clutch assembly. The mechanical properties of the speed reducer and the clutch assembly are known such that the operational parameters of the motor for driving the breaker shaft can be used to determine the rotational speed and loading of the breaker shaft. Although any of the variety of parameters described herein can be used to control the operation of the breaker shaft, this exemplary embodiment uses a loading of the motor (e.g., power, torque, etc.). The controller 1100 receives signals from the various sensors described above to determine the parameters of the motor drive.

Following step 1205, the parameter of the motor or motor drive determined at step 1205 is compared by the controller 1100 to one or more threshold values. In some embodiments, the controller 1100 compares the parameter to one threshold value (e.g., an over-load value) or two threshold values (e.g., an over-load value and an under-load value). In other embodiments, any plurality of threshold values can be implemented. The number of threshold values implemented in the process 1200 depends upon a desired precision for the control of the breaker shaft. For example, the determined motor or motor drive parameter can be continually compared to a series of threshold values and the operational speed of the breaker motor and breaker shaft can be correspondingly controlled with small modifications to maintain a maximum throughput of, or limited wear on, the industrial machine.

If the value of the parameter is greater than or approximately equal to the threshold value (e.g., in the case of an over-load), the controller 1100 adjusts the operation of the breaker shaft by slowing down the breaker motor (step 1215) and the process 1200 returns to step 1205. If, at step 1210, the value of the parameter is not greater than or approximately equal to the threshold value, the process 1200 returns to step 1205 where the motor or motor drive parameter is again determined.

Figure 17:
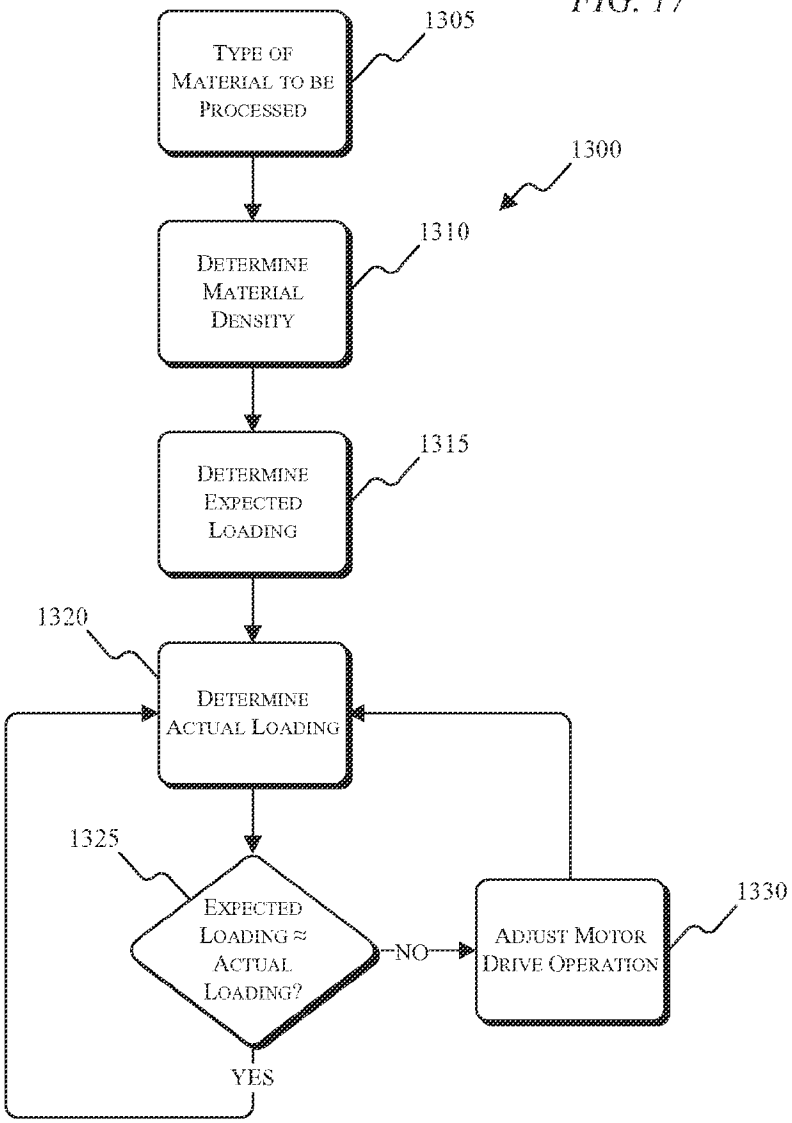
FIG. 17 is a process for controlling an industrial machine according to another embodiment of the invention.

FIG. 17 is another process 1300 for controlling the operation of an industrial machine that includes a breaker shaft and a breaker motor. At step 1305, the controller 1100 receives an indication of a type of material that the industrial machine is to process. The indication can be, for example, an operator input, a preprogramed type of material, etc. Based on the type of material that the industrial machine is to process, a density for the material can be determined (step 1310). The density can be retrieved by the controller 1100 from memory 1140, input by an operator, etc. Based on the type of material to be processed and the density of that material, the controller 1100 determines an expected loading for the material when it is being processed by the industrial machine. For example, for a feeder-breaker, the loading can correspond to an expected weight when the material is loaded on the conveyor assembly. Additionally or alternatively, the loading can be a loading experienced by the breaker shaft and determined as described above with respect to the process 1200.

At step 1320, the actual loading experienced by the conveyor is determined, for example, based on one or more weigh scales, pressure sensors, strain gauges, etc. Additionally or alternatively, the loading of the breaker shaft or breaker motor is determined as described above. If the load determined at step 1320 is approximately equal to the expected loading (step 1325), the process 1300 returns to step 1320 to again determine the actual loading. If, at step 1325, the actual loading is not approximately equal to the expected loading, the operation of the motor drive is adjusted. The motor drive parameters can correspond to, for example, either the breaker motor (e.g., speed up or slow down) or the conveyor motor (e.g., speed up or slow down). In some embodiments, if a harder material is being processed by the industrial machine than expected, either the breaker shaft and motor are slowed down or the conveyor and motor are slowed down to reduce the loading on the breaker shaft. If a softer material is being processed by the industrial machine, the conveyor and motor can be sped up or the breaker shaft and motor can be speed up to increase loading and maximize material throughput. Following step 1330, the process 1300 returns to step 1320 and the actual loading is again determined.

Thus, the invention provides, among other things, an industrial machine including a breaker device and a variable speed drive for controlling the rotational speed of the breaker device. Various features and advantages of the invention are set forth in the following claims.

What is claimed is:

1. An industrial mining machine comprising:

a breaker motor having a rotational speed;

a breaker shaft mechanically coupled to an output of the breaker motor;

a plurality of crushing tools coupled to the breaker shaft, the plurality of crushing tools operable to crush a mined material;

a conveyor configured to transport the mined material through the industrial machine;

a sensor configured to generate a signal related to a parameter of the breaker motor; and a controller configured to receive the signal from the sensor, determine a value for the parameter of the breaker motor based on the received signal, compare the value for the parameter of the breaker motor to a threshold value, and generate a control signal for modifying the rotational speed of the breaker motor based on the comparison of the value for the parameter of the breaker motor to the threshold value wherein the control signal reduces the rotational speed of the breaker motor when the value for the parameter is greater than the threshold value.

2. The industrial machine of claim 1, wherein the parameter of the breaker motor includes one of a voltage, a current, a motor speed, a motor torque, and a motor power.

3. The industrial machine of claim 1, wherein the parameter of the breaker motor includes motor loading.

4. The industrial machine of claim 1, wherein the threshold value corresponds to an over-loaded condition of the breaker motor.

5. The industrial machine of claim 1, further comprising a conveyor motor having a rotational speed.

6. The industrial machine of claim 5, wherein the controller is further configured to generate a second control signal for modifying the rotational speed of the conveyor motor based on the comparison of the value for the parameter of the breaker motor to the threshold value.

7. A method of controlling an industrial mining machine, the method comprising:

receiving a signal from a sensor related to a parameter of a breaker motor, the breaker motor having a rotational speed, the breaker motor mechanically coupled to a breaker shaft including a plurality of tools operable to crush a mined material;

determining a value for the parameter of the breaker motor based on the received signal;

comparing the value for the parameter of the breaker motor to a threshold value; and generating a control signal for modifying the rotational speed of the breaker motor based on the comparison of the value for the parameter of the breaker motor to the threshold value, wherein the control signal reduces the rotational speed of the breaker motor when the value for the parameter is greater than the threshold value.

8. The method of claim 7, wherein the parameter of the breaker motor includes one of a voltage, a current, a motor speed, a motor torque, and a motor power.

9. The method of claim 7, wherein the parameter of the breaker motor includes motor loading.

10. The method of claim 7, wherein the threshold value corresponds to an over-loaded condition of the breaker motor.

11. The method of claim 7, wherein the industrial machine is a double roll crusher.

12. The method of claim 7, wherein the controller is further configured to generate a second control signal for modifying a rotational speed of a conveyor motor based on the comparison of the value for the parameter of the breaker motor to the threshold value.

13. An industrial mining machine comprising:

a breaker motor having a rotational speed;

a breaker shaft mechanically coupled to an output of the breaker motor;

a plurality of crushing tools coupled to the breaker shaft, the plurality of crushing tools operable to crush a mined material;

a sensor configured to generate a signal related to a parameter of the breaker motor; and a controller configured to receive the signal from the sensor, determine a value for the parameter of the breaker motor based on the received signal, compare the value for the parameter of the breaker motor to a threshold value, and generate a control signal for modifying the rotational speed of the breaker motor based on the comparison of the value for the parameter of the breaker motor to the threshold value, wherein the control signal reduces the rotational speed of the breaker motor when the value for the parameter is greater than the threshold value.

14. The industrial machine of claim 13, wherein the industrial machine is a feeder-breaker.

15. The industrial machine of claim 13, further comprising a conveyor configured to transport the material through the industrial machine, and a conveyor motor having a rotational speed.

16. The industrial machine of claim 15, wherein the controller is further configured to generate a second control signal for modifying the rotational speed of the conveyor motor based on the comparison of the value for the parameter of the breaker motor to the threshold value.

17. The industrial machine of claim 13, wherein the parameter of the breaker motor includes motor loading.

18. The industrial machine of claim 13, wherein the threshold value corresponds to an over-loaded condition of the breaker motor.

* * * * *